US007412918B2

(12) United States Patent
Lauer

(10) Patent No.: US 7,412,918 B2
(45) Date of Patent: Aug. 19, 2008

(54) FIREARM CAMOUFLAGE SYSTEM

(76) Inventor: Steven M. Lauer, 2115 Declaration Dr., Eau Claire, WI (US) 54703

( * ) Notice: Subject to any disclaimer, the term of this patent is extended or adjusted under 35 U.S.C. 154(b) by 401 days.

(21) Appl. No.: 10/998,210

(22) Filed: Nov. 26, 2004

(65) Prior Publication Data

US 2006/0112606 A1 Jun. 1, 2006

(51) Int. Cl.
*F41H 5/12* (2006.01)
*F41H 5/00* (2006.01)

(52) U.S. Cl. ..... 89/36.01; 428/919; 101/128.1; 101/128.21

(58) Field of Classification Search ..... 101/128.1, 101/128.21; 89/36.01; 428/919
See application file for complete search history.

(56) References Cited

U.S. PATENT DOCUMENTS 4,265,947 A * 5/1981 Shank, Jr. ..... 428/34.7
4,837,056 A * 6/1989 Easley ..... 427/262
6,142,071 A * 11/2000 Fexer ..... 101/128

* cited by examiner

*Primary Examiner*—Stephen M Johnson
(74) *Attorney, Agent, or Firm*—Faier & Faier P.C.; James Michael Faier; Martin Faier

(57) ABSTRACT

The present invention provides a pre-packaged kit and a method for creating unique multi-toned custom patterns or camouflage on a surface, and in particular the surfaces of a firearm. The multi-toned custom patterns or camouflage are created by separating or peeling off pre-cut stencil/templates from sheet or roll stock adhesive backed masking material and applying the stencil/templates to a surface. The surface is subsequently sprayed with coatings, finishers and sealants. Additional layers of stencil/templates are then added and sprayed with various colors or tones of coatings, finishers and sealants to complete the desired effect on the firearm surface.

11 Claims, 3 Drawing Sheets

FIREARM CAMOUFLAGE SYSTEM

FIELD OF THE INVENTION

The present invention relates to a kit and a method for creating unique multi-toned custom patterns or camouflage on a surface, and in particular the surfaces of a firearm.

BACKGROUND AND DESCRIPTION OF THE RELATED ART

Concealment of firearms has always been of primary concern to a marksman. If the marksman is a hunter, various means of camouflaging his weapons to make them less perceptible to his prey are employed. In addition, the military uses camouflage to hide weapons, equipment, and people from the enemy. In general, the primary goal of camouflage is to make the object blend into the environment.

The camouflage patterns and systems employed by hunters and the military use a variety of different colors which generally match colors found in the environment in which the object to be concealed is located. In addition to the aspect of coloration, the various patterns or distributions of color tones on the surface of the object aid in confusing the visual perception of the intended target or pursuer. Marksmen also desire to individualize their firearms by applying unique designs to their firearms for purely decorative purposes as well.

Besides the decorative aspect, marksmen also wish to finish and protect their weapon from wear and environmental effects. Parkerizing is a metal etching process that employs phosphates to produce a hard matte or dull finish that is corrosion resistant, very durable to mar, scratches and abrasion, and is anti reflective with excellent oil holding properties. Additionally, the marksman may apply coatings, finishers and sealants such as the DuraCoat® line of products, which are manufactured by the Steve Lauer Painting and Decorating, Inc., to a firearm to either augment or substitute for the Parkerizing process.

A number of methods have been proposed to provide for a decorative or camouflaged surface on objects including firearms. Some such proposed methods are found in U.S. Pat. No. 5,792,516 to Beretta; U.S. Pat. No. 5,778,590 to Browning et al.; U.S. Pat. No. 5,615,508 to Miller et al.; U.S. Pat. No. 4,868,019 to Knickerbocker; U.S. Pat. No. 4,644,987 to Kiang; U.S. Pat. No. 2,339,317 to Ayers; U.S. Pat. No. 2,294,875 to Hexter et al.; U.S. Pat. No. 2,190,691 to Barclay; and U.S. Pat. No. 1,305,296 to Mackay.

In contrast to these conventional camouflage, decorative and coating methods, the present invention provides for a method and a pre-packaged kit that contains all the elements required to spray on or apply colored and hardened protective coatings to a firearm, in an additive layered process with stencil/templates, that results in the generation of unique multi-toned custom patterns or camouflage on a surface, and in particular the surfaces of a firearm, none of the prior art references facilitate the application of a decorative pattern or camouflage to a surface in the manner of the present invention.

In particular the method proposed by Browning et al. (U.S. Pat. No. 5,778,590) presents a protective cover for a long-barreled firearm, wherein the protective cover is made up of thin vinyl sheets, treated with application adhesive, bearing a camouflage design. Miller et al. (U.S. Pat. No. 5,615,508) discloses a decorative layer of fabric encapsulated by a layer of transparent fiberglass. Kiang (U.S. Pat. No. 4,644,987) describes a protective covering device for rifles comprising an integral fiber cloth sheet of elastic nature designed to fit the shape of a rifle stock. Barclay (U.S. Pat. No. 2,190,691) and Mackay (U.S. Pat. No. 1,305,296) describe camouflaging large military objects such as planes and ships, respectively through the use of paint and stencils, however they do not disclose a pre-packaged kit and an additive layered process with stencil/templates for generating unique multi-toned custom patterns or camouflage on a surface, and in particular the surfaces of a firearm. Knickerbocker (U.S. Pat. No. 4,868,019) discloses preferred camouflage color schemes. Finally, Ayers (U.S. Pat. No. 2,339,317) and Hexter et al. (U.S. Pat. No. 2,294,875) both disclose coating materials for camouflage applications.

SUMMARY OF THE INVENTION

The present invention provides for a pre-packaged kit and a method to apply a custom multi-toned pattern or camouflage to a surface, in particular the surfaces of a firearm, wherein all the elements of the process are pre-packaged in a self contained kit that can be purchased and applied by the consumer. The pre-packaged kit combines the coatings, hardeners, pre-cut stencil/templates, written and multi-media instructions (i.e. DVD, video cassette etc.) for the application of custom multi-toned patterns or camouflage to a target surface. The stencil/template designs are generated on a computer, and are die cut on sheet or roll stock adhesive backed masking material. The coatings come in varied colors according to the effect desired and the environment in which the surface is to be employed. The marksman peels off the pre-cut stencil/template from an applicator sheet and places it on the target surface. The marksman then sprays or applies a coating to the target surface. Additional patterns are created by laying additional stencil/templates and applying more layers of coatings. The stencil/templates are removed when all the colors have been applied.

OBJECTS AND ADVANTAGES OF THE INVENTION

It is the object of the present invention to provide a novel method to create custom multi-toned patterns or camouflage on a surface, in particular on the surfaces of a firearm.

Another object is to provide a novel pre-packaged kit containing all the elements required to create custom multi-toned patterns or camouflage on a surface, in particular on the surfaces of a firearm.

Another object is to provide a novel process that works equally well at home, the gun shop, or manufacturing facility for creating multi-toned patterns or camouflage on a surface, in particular on the surfaces of a firearm.

Another object is to create peal off stencils/templates that are used to create custom multi-toned patterns or camouflage on a surface, in particular the surfaces of a firearm.

Another object is to provide a method to create custom multi-toned patterns or camouflage on a surface, in particular the surfaces of a firearm, that is robust with regard to corrosion, chemical, water, scratch, chip, and mar resistance.

These and other objects and advantages of the invention will become more apparent as this description proceeds, taken in conjunction with the accompanying drawings.

DETAILED DESCRIPTION OF THE PREFERRED EMBODIMENTS

Figure 1:
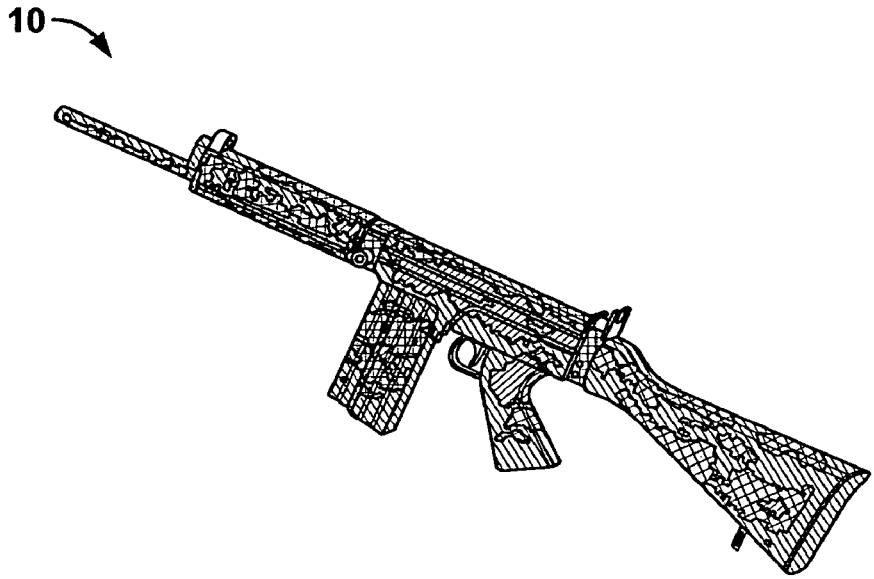
FIG. 1 is a perspective view of a firearm with a multi-toned or camouflage pattern already applied.
Figure 2:
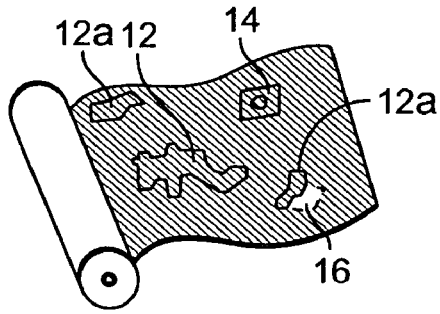
FIG. 2 is a perspective view of pre-cut stencil/templates on sheet or roll stock adhesive backed masking material.

With reference to the accompanying drawings and particularly FIGS. 1 and 2 a kit and a method to apply multi-tone patterns or camouflage to a firearm 10 through the use of adhesive backed stencil/templates 12 and female adhesive backed accent stencil/templates 14 pre-cut on release sheet 16 are illustrated. In the embodiment of FIG. 1 a firearm that has a complete multi-tone pattern or camouflage applied is shown.

To ensure proper adhesion of multi-tone patterns or camouflage the visible surfaces of the firearm 10 need to be properly prepared. The preparation process begins by disassembling the firearm 10 and cleaning the individual parts. Exposed surfaces should be blasted with 60-120 grit aluminum oxide to provide pitting or an edge to the surface. The parts of the firearm 10 should then be degreased with degreaser solutions such as ACN, NST, laquer thinner, or an equivalent product that dries quickly and leaves no residue.

Parkerizing or anodizing the parts of firearm 10 is then recommended but is not required if a DuraCoat® sealer is to be applied as a base finish. The DuraCoat® or similar hardened coatings, finishers and sealants may be introduced by airbrush, conventional automotive spraygun, high velocity low pressure (HLVP) systems or airless paint sprayer. The DuraCoat® or similar hardened coatings, finishers and sealants should be sprayed on with smooth, even passes, building the coating to a desired thickness. Areas of the firearm 10 which experience greater wear should have a thicker application applied. High tolerance areas should have a thinner coating. Spraying should be stopped intermittently to allow solvents to flash-off. Spray distance from the applicator to the firearm 10 should vary from 1 to 6 inches depending on the desired effect.

Figure 3:
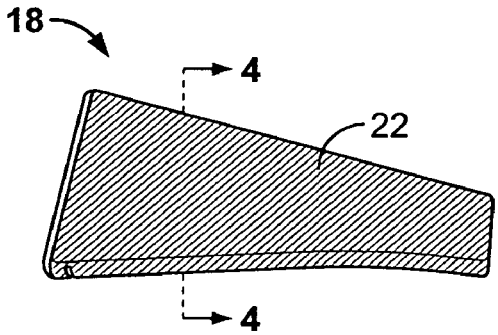
FIG. 3 is a perspective view of part of the firearm of FIG. 1 illustrating the firearm stock with only the initial base coating applied.
Figure 4:
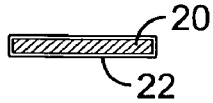
FIG. 4 is a sectional view of the firearm stock along line 4-4 of FIG. 3.

The firearm 10 should then be reassembled and areas should be masked or plugged that are not to be further treated. For the purpose of illustration only the stock portion 18 of the firearm 10 will be shown in the application process. FIG. 3 illustrates the firearm stock 18 of the firearm 10 of FIG. 1 with only the initial base coating 22 applied. A cross sectional view of the firearm stock 18 whose cross sectional area 20 with base coat 22 applied to firearm is illustrated in FIG. 4. At this point the firearm 10 is ready for the application of multi-tone patterns or camouflage to be applied.

Figure 5:
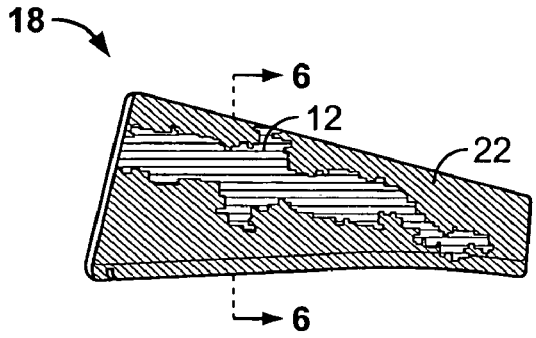
FIG. 5 is a perspective view of the firearm stock with a pre-cut stencil/templates applied.
Figure 6:
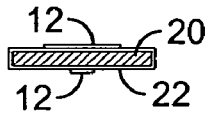
FIG. 6 is a sectional view of the firearm stock along line 6-6 of FIG. 5.
Figure 7:
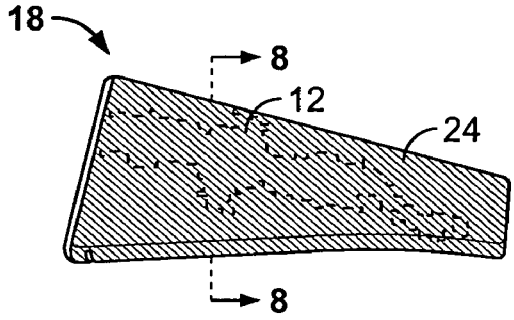
FIG. 7 is a perspective view of the firearm stock completely covered in a second color or tone.
Figure 8:
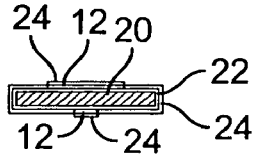
FIG. 8 is a sectional view of the firearm stock along line 8-8 of FIG. 7.

The user or marksman peels off the desired pre-cut adhesive backed stencil/templates 12 from release sheet 16 of FIG. 2. Alternatively, the stencil/templates may be formed from sheet stock, wherein the user applies or sprays an adhesive coating on to the back of the stencil/templates or to the target surface, prior to the application of the stencil/template to the target surface. The adhesive backed stencil/templates 12 are then applied to the base coat 22 of the firearm stock 18 as shown in FIG. 5. A cross sectional view of the firearm stock 18 whose cross sectional area 20 with base coat 22 and adhesive backed stencil/templates 12 applied to firearm is illustrated in FIG. 6. A second color or tone 24 is then applied or sprayed on the firearm stock 18, such that the entire surface and adhesive backed stencil/templates 12 are completely covered as shown in FIG. 7. A cross sectional view of the firearm stock 18, with the second color or tone 24 and adhesive backed stencil/templates 12 applied, is illustrated in FIG. 8. The adhesive backed stencil/templates 12 are to be left on the firearm stock 18 and continue to act as a mask as additional additive layers of colors or tones are added to the firearm 10. Allow for sufficient curing of the second color or tone 24. Baking the firearm 10 in an oven for 10 to 15 minutes at 110 degrees F. will hasten the drying process.

Figure 9:
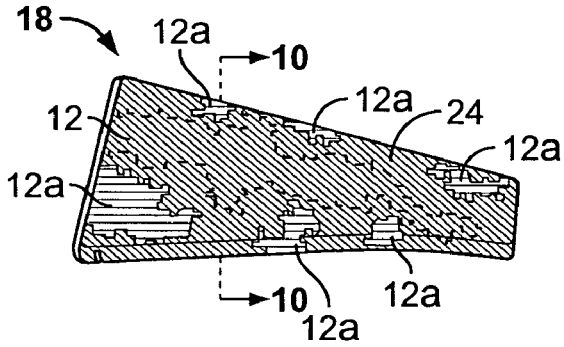
FIG. 9 is a perspective view with additional pre-cut stencil/templates applied to the firearm stock.
Figure 10:
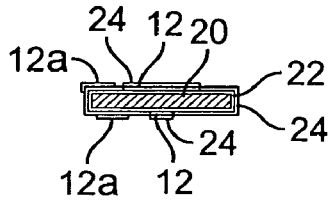
FIG. 10 is a sectional view of the firearm stock along line 10-10 of FIG. 9.
Figure 11:
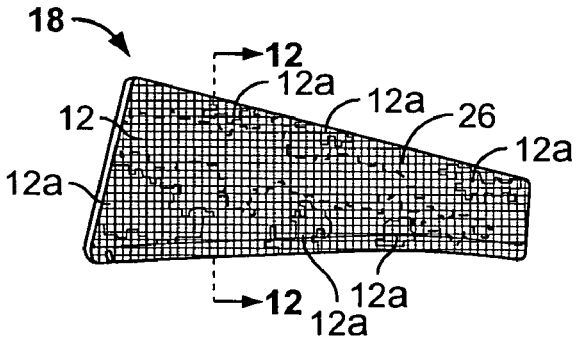
FIG. 11 is a perspective view of the firearm stock completely covered in a third color or tone.
Figure 12:
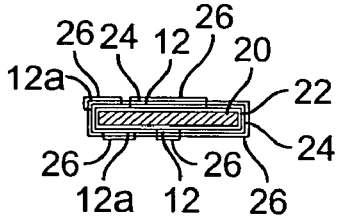
FIG. 12 is a sectional view of the firearm stock along line 12-12 of FIG. 11.
Figure 13:
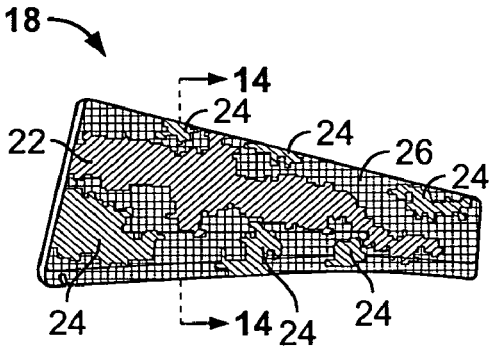
FIG. 13 is a perspective view of the firearm stock with all pre-cut stencil/templates removed.
Figure 14:
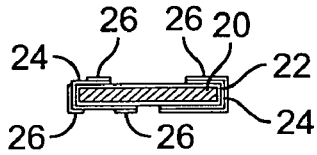
FIG. 14 is a sectional view of the firearm stock along line 14-14 of FIG. 13.
Figure 15:
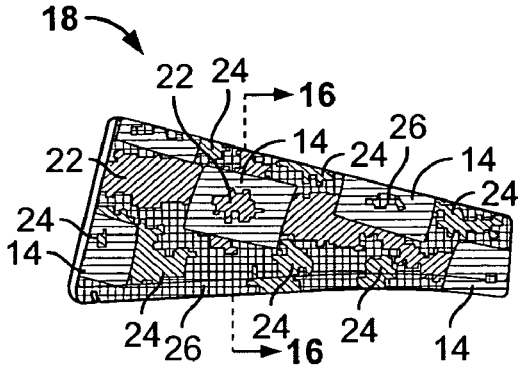
FIG. 15 is a perspective view with accent female pre-cut stencil templates applied to the firearm stock.
Figure 16:
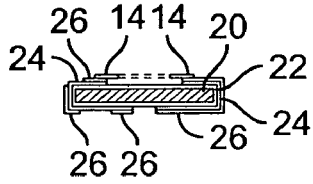
FIG. 16 is a sectional view of the firearm stock along line 16-16 of FIG. 15.
Figure 17:
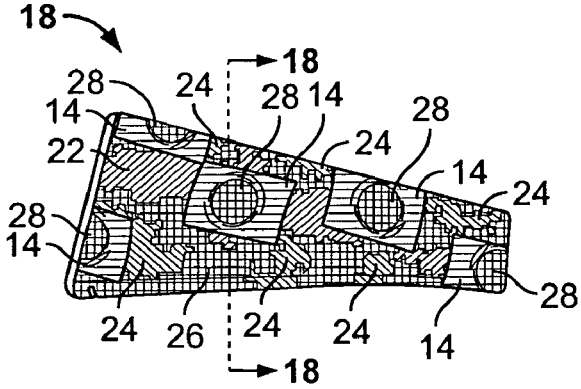
FIG. 17 is a perspective view of accent color or tone selectively applied to female pre-cut stencil templates applied to the firearm stock.
Figure 18:
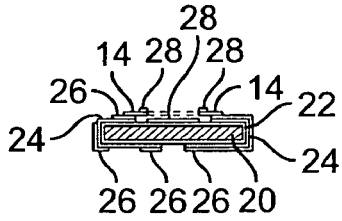
FIG. 18 is a sectional view of the firearm stock along line 18-18 of FIG. 17.
Figure 19:
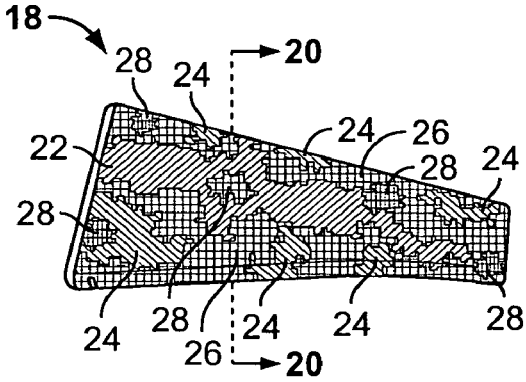
FIG. 19 is a perspective view with accent female pre-cut stencil templates removed from the firearm stock.
Figure 20:
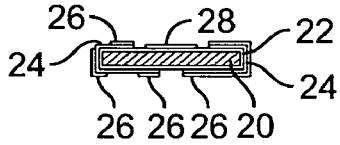
FIG. 20 is a sectional view of the firearm stock along line 20-20 of FIG. 19.

In FIG. 9 additional pre-cut adhesive backed stencil/templates 12*a* may be peeled from release sheet 16 and applied to the firearm stock 18. A cross sectional view of the firearm stock 18, with the base coat 22, second color or tone 24 and adhesive backed stencil/templates 12 and 12*a* applied, is illustrated in FIG. 10. The firearm stock 18 and adhesive backed stencil/templates 12 and 12*a* are completely covered by spraying a third color or tone 26 as shown in FIG. 11. A cross sectional view of the firearm stock 18, with the third color or tone 26 and adhesive backed stencil/templates 12 and 12*a* applied, is illustrated in FIG. 12. After the third color or tone 26 has been allowed to dry all the adhesive backed stencil/templates 12 and 12*a* are removed as illustrated in FIG. 13. A cross sectional view of the firearm stock 18, with the base coat 22, second color or tone 24, and the third color or tone 26 applied is shown in FIG. 14. At this stage accent female adhesive backed pre-cut stencil templates 14 peeled from release sheet 16 can be applied to the firearm stock 18 as shown in FIG. 15 and in a cross sectional view in FIG. 16. Selective colors or tones 28 can be introduced to the areas enclosed by the accent female adhesive backed pre-cut stencil templates 14 as illustrated in FIG. 17 and in a cross sectional view in FIG. 18. The process of adding multi-tone patterns or camouflage is completed with removal of the accent female adhesive backed pre-cut stencil templates 14, and the application of an optional clear coating sealer to the entire firearm stock 18 surface. FIG. 19 of firearm stock 18, and the corresponding cross sectional area FIG. 20 illustrate the resultant four layers of colors or tones 22, 24, 26, and 28 that provides for a custom multi-toned pattern or camouflage finish on the surface of the firearm stock 18.

While the preferred embodiments of the invention have been disclosed in considerable detail, variations based on the inventive features disclosed herein are within the skill of the ordinary artisan, and the scope of the invention should not be limited by the examples. To properly determine the scope of the invention, an interested party should consider the claims herein, and any equivalent thereof. In addition, all citations herein were incorporated by reference.

Having thus described my invention, I claim:

1. A kit for creating unique multi-toned custom patterns or camouflage on a surface, and in particular the surfaces of a firearm comprising:

a set of coatings that dry at room temperature for creating a camouflaged surface;

hardener for hardening said coatings;

pre-cut stencil/templates for defining said coated camouflaged surface; and, a set of instructions for accomplishing said camouflaged patterns.

2. The kit for creating unique multi-toned custom patterns or camouflage on a surface, and in particular the surfaces of a firearm according to claim 1, wherein said set of coatings come in varied colors or tones according to effect desired and the environment said surface or firearm is to be employed.

3. The kit for creating unique multi-toned custom patterns or camouflage on a surface, and in particular the surfaces of a firearm according to claim 1, wherein said set of coatings offer a robust finish with regard to corrosion, chemical, water, scratch, chip, and mar resistance.

4. The kit for creating unique multi-toned custom patterns or camouflage on a surface, and in particular the surfaces of a firearm according to claim 1, wherein said set of coatings are formulated to be applied to said surface by airbrush, conventional automotive spraygun, high volume low pressure (HLVP) systems, airless paint sprayer.

5. The kit for creating unique multi-toned custom patterns or camouflage on a surface, and in particular the surfaces of a firearm according to claim 1, wherein said pre-cut stencil/templates are die cut on a sheet or roll stock adhesive backed masking material.

6. The kit for creating unique multi-toned custom patterns or camouflage on a surface, and in particular the surfaces of a firearm according to claim 5, wherein said roll stock adhesive backed masking material is made from vinyl with a paper release backing.

7. The kit for creating unique multi-toned custom patterns or camouflage on a surface, and in particular the surfaces of a firearm according to claim 5, wherein said sheet has adhesive manually applied or sprayed on to the back of said sheet prior to application to a target surface.

8. The kit for creating unique multi-toned custom patterns or camouflage on a surface, and in particular the surfaces of a firearm according to claim 1, wherein said pre-cut stencil/templates are designed on a computer and are die cut on said sheet or said roll stock adhesive backed masking material.

9. The kit for creating unique multi-toned custom patterns or camouflage on a surface, and in particular the surfaces of a firearm according to claim 1, wherein said pre-cut stencil/templates are manually hand cut on said sheet or said roll stock adhesive backed masking material.

10. The kit for creating unique multi-toned custom patterns or camouflage on a surface, and in particular the surfaces of a firearm according to claim 1, wherein said pre-cut stencil/templates retain their adhesive qualities after separation from a backing for application to said surface.

11. The kit for creating unique multi-toned custom patterns or camouflage on a surface, and in particular the surfaces of a firearm according to claim 1, wherein said set of instructions can be in written form, on a DVD, CDROM, audio cassette, or video cassette.

* * * * *